US006439483B2

(12) United States Patent
Meyer

(10) Patent No.: US 6,439,483 B2
(45) Date of Patent: Aug. 27, 2002

(54) VARIABLE ORIFICE ELECTRONICALLY CONTROLLED COMMON RAIL INJECTOR (VOECRRI)

(76) Inventor: Andrew E. Meyer, Rte. 3, Box 764, Harpers Ferry, WV (US) 25425

( * ) Notice: Subject to any disclaimer, the term of this patent is extended or adjusted under 35 U.S.C. 154(b) by 0 days.

(21) Appl. No.: 09/778,742

(22) Filed: Feb. 8, 2001

Related U.S. Application Data

(60) Provisional application No. 60/181,569, filed on Feb. 10, 2000.

(51) Int. Cl.[7] ..... B05B 1/30; F02M 51/00

(52) U.S. Cl. ..... 239/585.1; 239/533.3; 239/533.9; 239/533.11; 239/533.12; 239/583; 239/584

(58) Field of Search ..... 239/533.2, 533.3, 239/533.9, 533.11, 533.12, 585.1, 583, 584

(56) References Cited

U.S. PATENT DOCUMENTS 3,612,407 A * 10/1971 Itano
4,168,804 A * 9/1979 Hofmann ..... 239/533.11
4,238,075 A * 12/1980 Bauder ..... 239/533.4
4,339,080 A * 7/1982 Kopse ..... 239/533.3
4,693,420 A * 9/1987 Klomp ..... 239/87
5,645,225 A * 7/1997 Hasegawa et al. ..... 239/533.12
5,738,283 A * 4/1998 Potz et al. ..... 239/533.3

* cited by examiner

*Primary Examiner*—Robin O. Evans
(74) *Attorney, Agent, or Firm*—Low and Low; Warren N. Low; Renee S. Rutkowski

(57) ABSTRACT

A unique variable orifice electronically controlled common variable rail injector (VOECCRI) for use in internal combustion engines characterized in part by the provision of injection ports or orifices along a tip portion of the nozzle housing having an internal cylindrical surface, and which cooperates in sealing and sliding relation with an internal hollow fuel needle having a cylindrical outer surface. In seating, the needle seats against a frusto-conical seat carried in the closure sac at the lower tip of the assembly, whereby leakage is controlled and precise opening of the injection orifices can be effected and programmed, as desired.

12 Claims, 5 Drawing Sheets

VARIABLE ORIFICE ELECTRONICALLY CONTROLLED COMMON RAIL INJECTOR (VOECRRI)

CROSS-REFERENCE TO RELATED APPLICATION

This application is based upon my prior Provisional Application Ser. No. 60/181,569, filed Feb. 10, 2000.

FEDERALLY SPONSORED RESEARCH OR DEVELOPMENT (not applicable)

BACKGROUND OF THE INVENTION

Compression Ignited Direct Injection (CIDI) engines, as diesel engines, emit more pollution than necessary because conventional fuel injection systems as presently employed cannot control fuel delivery with sufficient accuracy during cold starts and load/speed transients.

At the present, fuel injection systems purport to control the overall injection rate by controllably raising and lowering mean injection pressure (MIP). When the injection orifice size is fixed in the fuel injector, there is unavoidably poor atomization at low injection rates, and while at the usual relatively low engine cranking speed, there is both poor atomization of the fuel as well as an excessive injection rate. With currently employed injectors, therefore, there is little flexibility in shaping the injection rate/crank angle curve during engine operation to maximize or increase fuel injection and engine efficiency. Typical prior art injection nozzles are shown in List U.S. Pat. No. 4,892,065, Kopse U.S. Pat. No. 4,339,080, and Klomp U.S. Pat. No. 4,096,995, for example, among others.

BRIEF SUMMARY OF THE INVENTION

In the preferred variable orifice fuel injector (VOECRRI) of the invention, the injection rate of the diesel fuel is specifically controlled by varying the effective size of the orifice or orifices through which fuel flows into the engine. Further, in accordance with the invention, the VOECRRI can be designed to fit within a 14 or 15 mm. cylinder or even a smaller cylinder, which advantageously allows it to be used with relatively tiny four-valve cylinders in four cylinder 1.2 liter CIDI engines, for example. Such small engines are particularly desired and required as diesel engines for use in hybrid electric vehicles, and wherein space for fuel injection equipment is very limited.

Additionally, the VOECRRI of the invention contributes to reduction in pollution from diesel engines, is less costly to manufacture than currently employed common rail systems, thereby enhancing widespread use and standardization on diesel engines. Further, diesels operate more satisfactorily with a slower start of fuel injection, which is readily accomplished with the injector structure of the invention.

The VOECRRI herein is a variable orifice, multi-orifice injector as a key component of an electronically controlled high-pressure common rail fuel injection system. While an electronically controlled actuator is preferred, the invention may also be employed with a hydraulic actuator.

A feature of the invention lies in the provision of a hollow or tubular fuel feed needle sliding within a ported cylindrical barrel adjacent the usual closed sac at the tip of the assembly, whereby fuel injection flow may be controlled by the axial position of the needle with respect to the injection orifices.

BRIEF DESCRIPTION OF THE DRAWINGS

Referring generally to the drawings.

DETAILED DESCRIPTION OF THE INVENTION

Figure 1:
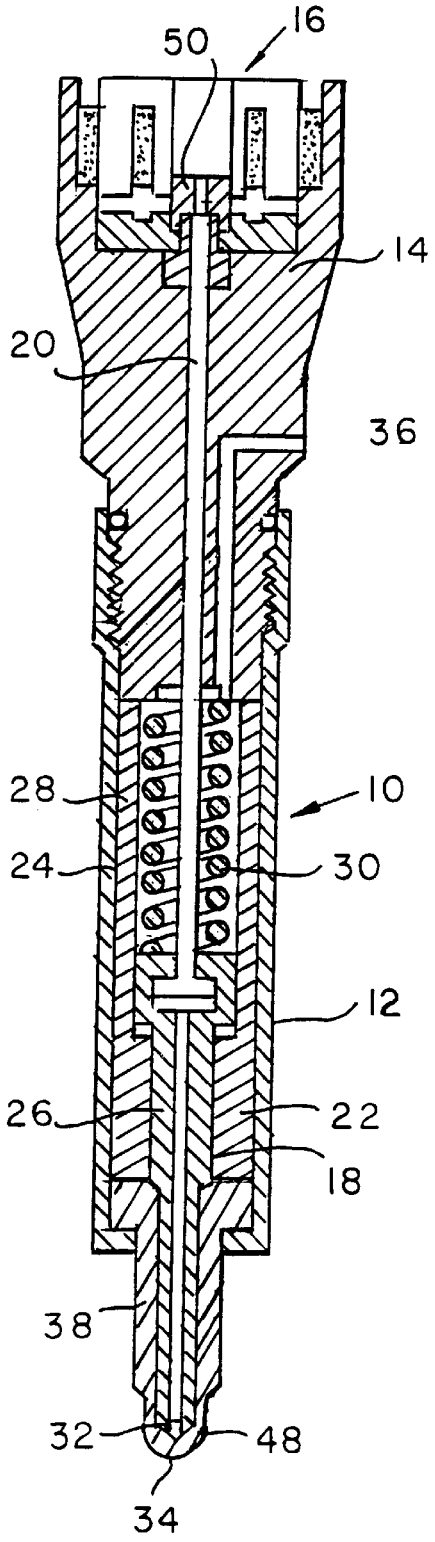
FIG. 1 is an enlarged (as approximately 1½ times actual size) sectional view of the injector of the present invention.
Figure 2:
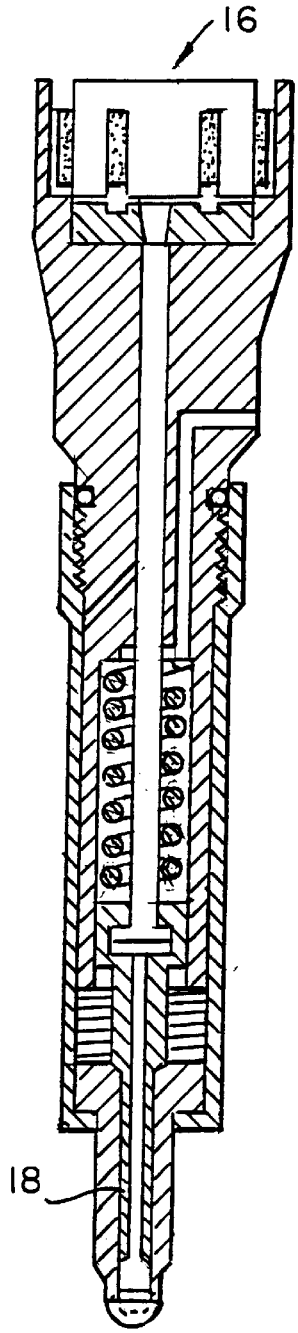
FIG. 2 is similar, but showing further modified details of construction.

Thus, with reference to the drawings, there is seen in FIG. 1 an overall view of an injector 10 of the present invention. The injector in many respects includes some conventional components, and includes an outer housing body or elongated cap 12 secured in leak-proof relation, as by threading, to an upper enlarged body portion 14 having a solenoid 16 of known form for lifting the hollow injection needle 18 by means of a lift rod 20 extending from the solenoid down to an enlarged head on needle 18. An inner body 22 is received within the outer housing 12 and is of lesser diameter so as to provide a fuel return passage 24 between cap 12 and inner body 22. Further, body 22 includes a lower bore 26 for needle 18, and an enlarged bore 28 thereabove within which compression spring 30 is received to exert closing force upon needle 18 at seat 32 in sac 34, as seen in FIG. 4, at the end of outside tip 38.

Upper enlarged body 14 includes a high pressure fuel inlet and passage 36, which communicates with, bore 28. As seen in FIG. 1, the nozzle outside tip 38 is carried by and extends through the outer housing cap 12 at the lower end thereof, and has bore 40 to receive the needle 18. There is a very slight clearance as at 42 between the needle and the tip 38 and between the needle and the inner body 22 to permit a modicum of fuel to be present around the outside of needle 18 to a point near the tip, and which may serve as a lubricant for the needle.

Figure 4:
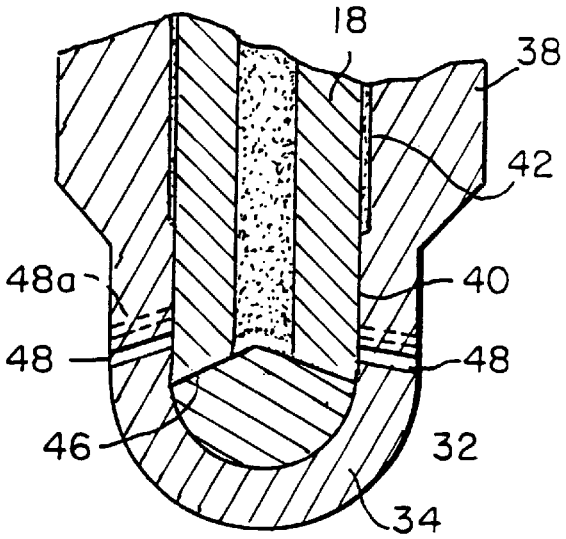
FIG. 4 is an enlarged view of the nozzle tip showing the closure sac and an insert seat therein.
Figure 8:
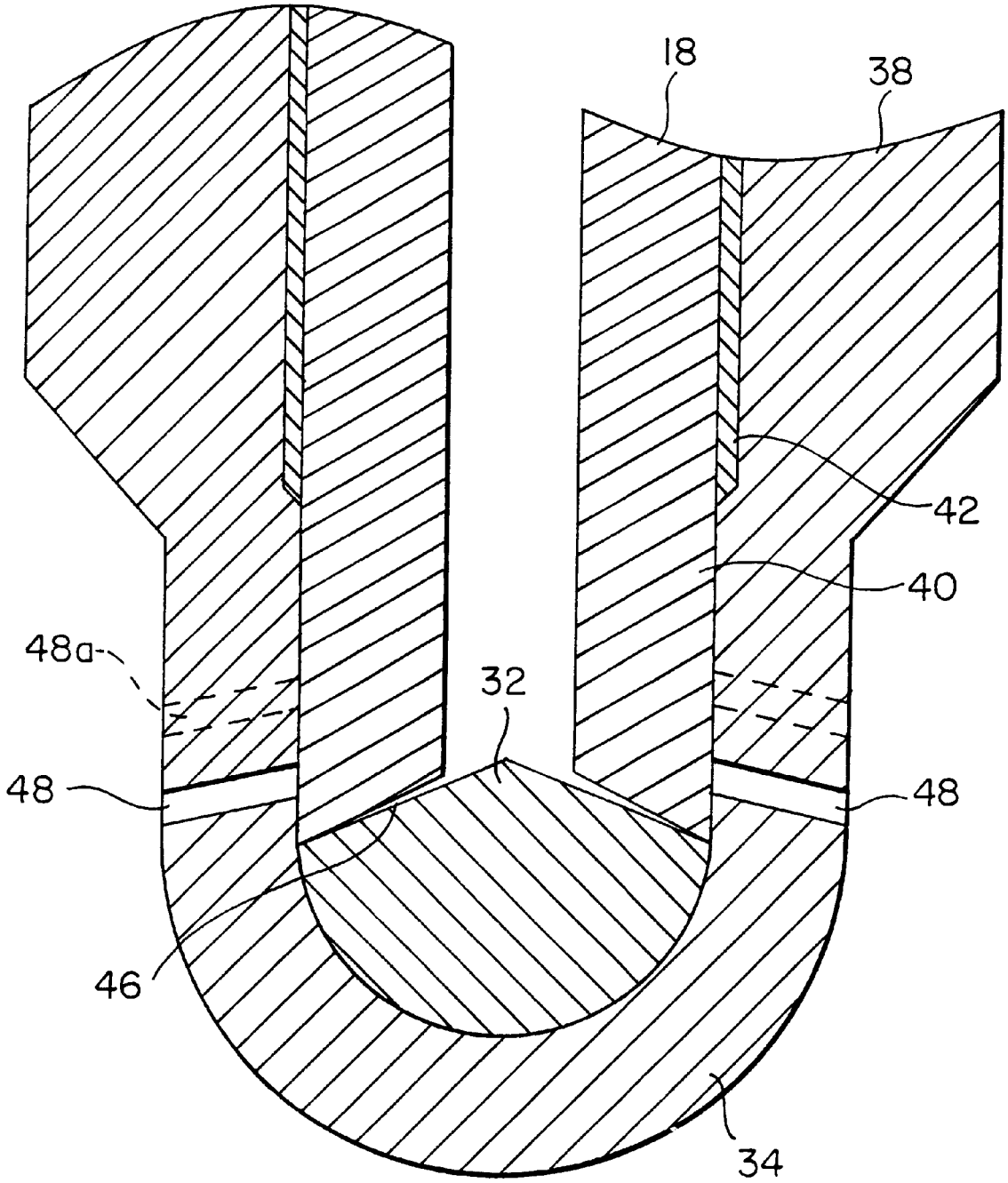
FIG. 8 is an enlarged view of the needle tip and seat showing an angular difference therebetween.

As better seen in the enlarged view of FIG. 4, the face of seat 32 in sac 34 is of shallow conical form to cooperate with a substantially complementary tapered configuration 46 at the distal end of needle 18, thereby to form a tight seat seal between the needle and the seat when the needle is fully closed. Preferably, as seen in FIG. 8, to further aid tight sealing, there is a very slight difference in angle, on the order of 1°, between the confronting surfaces, with the needle surface having the slightly more acute angle, as measured radially outwardly.

Injector orifices 48, two being shown, are provided in the cylindrical wall 46 of outer needle tip 38 close to its juncture with hemispherical sac 34. Additional like ports as those at 48 may be provided in a circumferential series about member 38 for high full cylinder flow injection. Further, one or more additional ports may be provided above those shown, also in the cylindrical tip portion 38 for greater control of timing and amount of fuel injection as the needle is raised.

An additional series of ports is shown for example in phantom lines at 48*a*.

Figure 3:
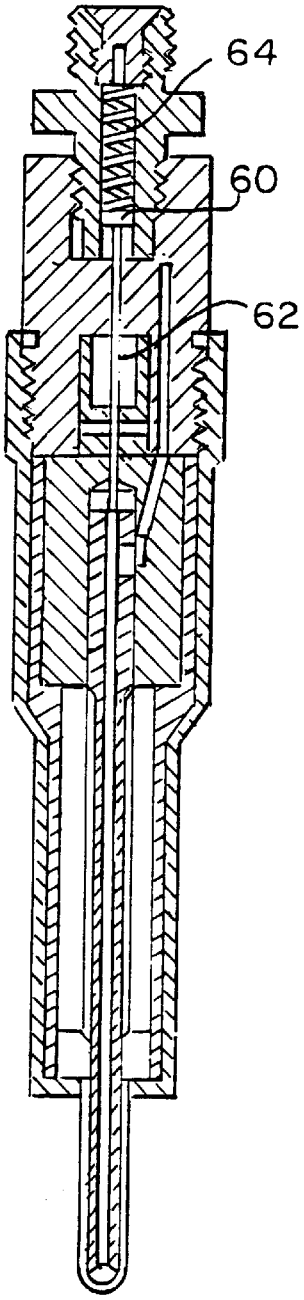
FIG. 3 shows a further modification utilizing hydraulic control, but with the same novel needle and sac structure.

It is important to observe that needle 18 is cylindrical, as is the inner wall of the bore 40 of outer tip end 38. The two mate in close sliding fit in the bore 40 as compared to the relief thereabove at 42. Accordingly, when needle 18 is seated on seat 32, as seen in FIG. 3, fluid fuel flow through the needle bore is blocked from flowing to ports 48, and in like manner, the close cylindrical fit of the needle within outer tip portion 38 precludes fuel flow from the clearance area 42 to ports 44. In this regard, the reverse conical taper of the needle with the noted angular difference with the seat as it seats at 46 tends under pressure to cause the needle to be biased to expand outwardly a minute amount along the conical surface, further enhancing the seal of the cylindrical needle against outer tip 46 thereat.

Figure 5:
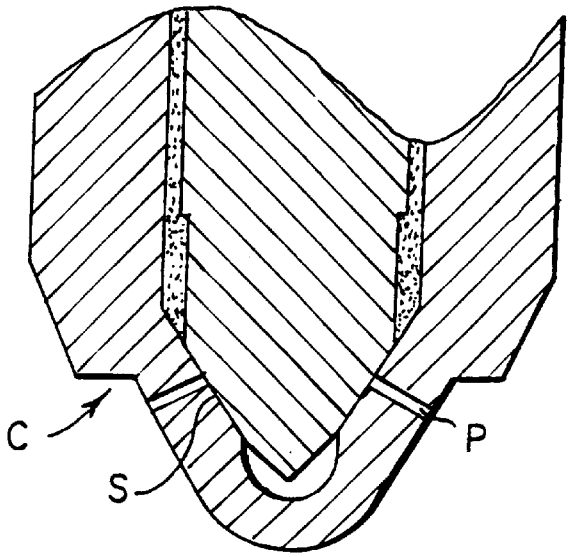
FIG. 5 is illustrative of a prior art nozzle tip and closure sac.

This contrasts markedly with a typical conventional nozzle C, for example, as seen in FIG. 5. In such a nozzle, the imperforate needle outer face at its lower end is conically tapered to seat on the like-tapered tip at S, which latter is ported at P, whereby (1) any upward movement of the needle substantially fully opens the adjacent injection ports, and (2) shutoff of fuel flow relies upon a tight conical seating of the needle immediately above the injection ports and below the surrounding fuel passage.

When needle 18 of the nozzle of the invention opens, as by actuation of solenoid 16 to elevate needle 18 against the force of spring 30 by means of lift rod 20, the reverse conical end of needle 18 lifts from seat 32 as the needle outer cylindrical surface slides upwardly along the mating cylindrical surface of outer tip 38.

At such time, fuel enters through the high-pressure fuel inlet 36 after having been pressurized to the desired injection level by an external high-pressure common rail fuel injection pump system. Such common rail systems for high pressure injection are generally known in the art, as, for example, set forth in SAE Paper 950452. From the high-pressure inlet 36, the fuel passes directly into the nozzle spring chamber 28 therebelow, thence the fuel under pressure passes through a slot or loose fit in the needle and actuator rod connection, and into the passage or bore formed in the needle down to the sac area, and out ports 48. The ports 48 are generally radial orifices in the tip cylindrical wall above sac 34. As shown, the ports or orifices are slightly downwardly inclined with respect to the needle 18. As noted, until the needle is lifted, the pressurized fuel cannot escape through the orifices, which are normally snugly closed by the needle periphery, and wherein the pressure of the fuel enhances a tight seal of the needle against its housing and the sac at the needle seat. Preferably, as indicated, there is a quite small difference in the angles of the substantially complementary frusto-conical needle and seat surfaces to aid further in tight seating and sealing.

Figure 6:
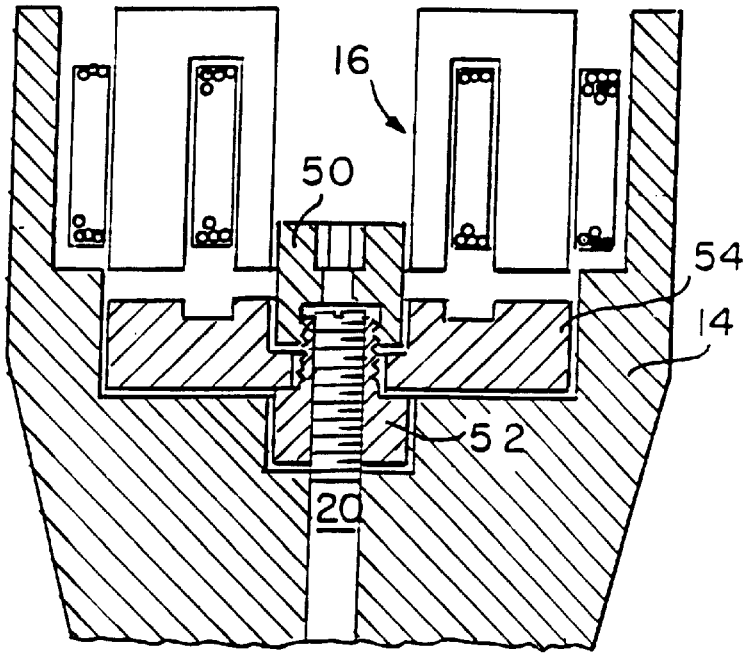
FIG. 6 is an enlarged view at the top of the actuator rod, with adjacent solenoid and clapper elements; and, FIG. 7 is a graph illustrating needle unseating forces.
Figure 7:
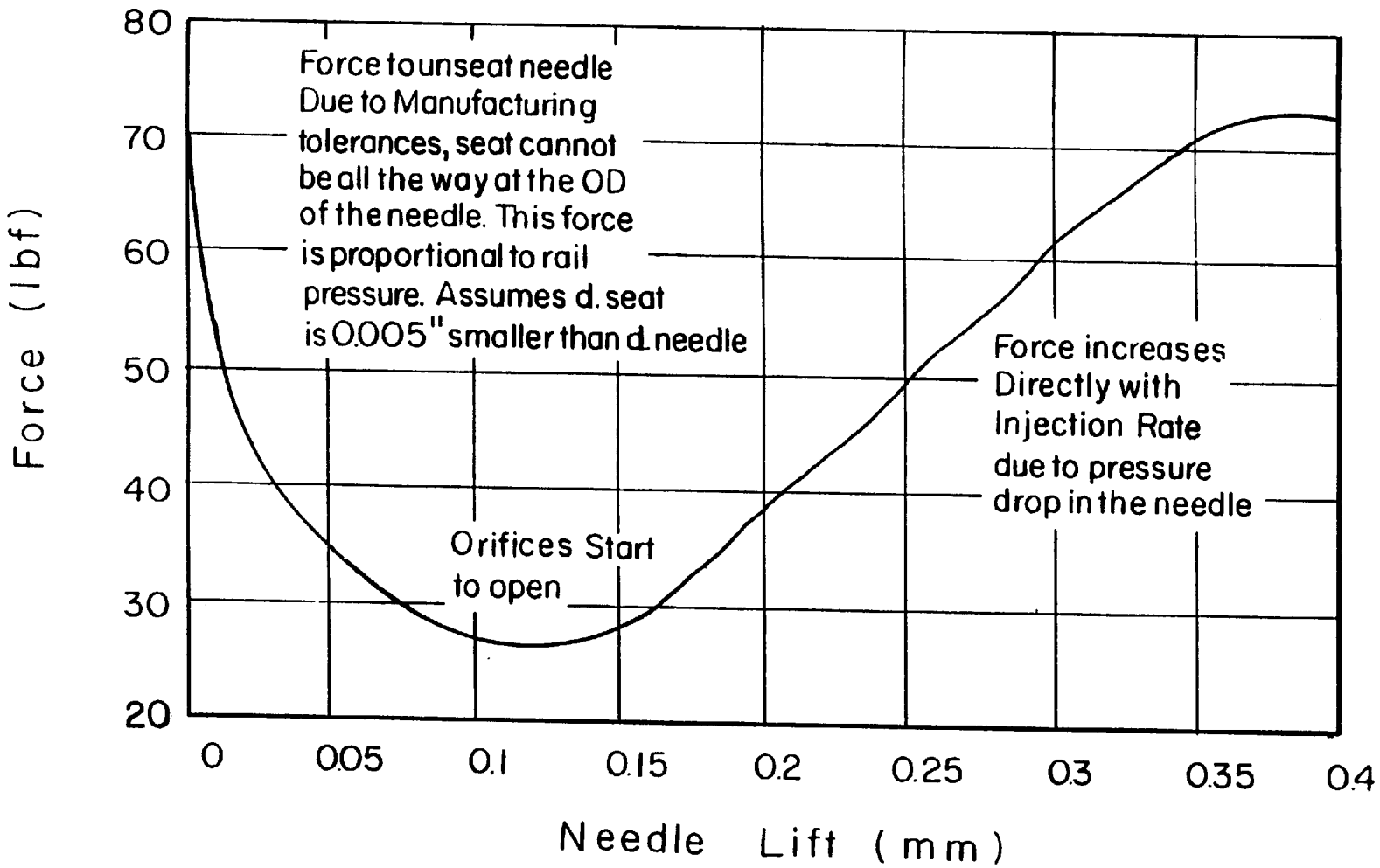

It will be seen further that under lifting rod control by a conventional electric solenoid device 16, the precise distance that the needle is selected to be elevated will control to what extent the orifices 48 are opened. Thus, for example, needle 18 may be programmed to elevate a distance sufficient to expose or uncover one-half of the area of the orifices. Or, as indicated above, needle 18 may be raised sufficiently to open fully the first series of orifices 48, while the upper series at 48*a* remain fully closed. The versatility of this needle system permits extensive programming and control of the fuel injection by the designing engineer. Illustratively, suitable controllable adjustment of terminal nut 50 at the top of lift rod 20, as seen in FIG. 6, controls the maximum lift distance. Lift rod nut 52 connected to nut 50 as by threading, is provided with known anti-rotation means, as a sliding slot connection at 54, for example to permit relative movement of nuts 50, 52 when nut 50 is turned.

It will be seen further that the lower face of nut 50 is vertically spaced a slight distance from solenoid clapper 54. Accordingly, the seated needle when the solenoid is actuated receives a slightly delayed positive impact from clapper 54, thereby imparting a shock lifting force to lift rod 20 and needle 18.

It is within the scope of this invention to employ other needle actuation devices, as piezoelectric actuators, known hydraulic systems as generally indicated in FIG. 3 wherein hydraulic pressure below the head 60 of lift rod 62 elevates the needle against spring 64, or even mechanical arrangements, but electric means as by the solenoid are preferred by virtue of the ease of precise control thereof.

Earlier attempts at variable orifice nozzles included orifice patterns causing the injected spray to change spray direction as the orifice was opened and closed. The axial sealing system of the present invention herein permits optimization of the determined angle and thickness of the leading edge of the needle to control variation in spray angle.

Sealing of the high-pressure chamber above the nozzle is accomplished in conventional manner with small clearances around the valve actuator rod and the balance plunger forming an upper portion of the needle. There is a balance barrel separate from the needle and has a slightly spherical shape on its bottom low pressure face to allow for manufacturing tolerances between the match fit in the barrel and the match fit at the bottom on the nozzle needle. The clearance along most of the nozzle needle does not need to be excessively tight. The match fit at the bottom of the nozzle needle is required only to seal the low-pressure fuel return from the engine combustion chamber and thus may not require the tight clearances needed in a high-pressure seal.

The fuel that may leak past the actuator rod through the small clearance thereat and the clearance at the balance plunger is at low pressure, and is routed to the clearance underneath the cap nut from which it collects and is fed out the fuel return. Indeed, with an increased clearance under the cap nut, and addition of a second low-pressure fuel passage, fuel could be circulated through the injector for cooling purposes.

The actuator rod 20 controls the valve nozzle. The rod is on the order of 2 mm. in diameter, whereby under a 30,000 psig injection pressure, the force acting upwardly on the rod is on the order of 146 pounds of force. This is balanced by a downward force exerted by pressure acting on the balance plunger and by spring 30, as a coil spring, around the actuator rod, so that the actuator needle rod junction, shown as a "T" junction, is in tension whenever there is pressure in the system. The spring also provides a quick return of the nozzle needle to its lowermost seated position in pulling away from the de-energized valve actuation solenoid at the top. A dimensioned stop may be positioned under the enlarged head of the nozzle needle to preclude excessive spring force acting on the nozzle at its lowermost seat, thereby preventing distortion or damage. Other stop devices having a similar effect may be employed.

While a spring is shown for providing the downward needle force, other means may be substituted therefor or used in combination therewith, as fluid pressure or a yieldable mechanical cam arrangement, for example.

A solenoid as noted is the nozzle driving means. Preferably, the clapper of the solenoid is positioned such that it has limited free upward motion before the needle moves from its seat as set forth, thereby providing an impact load to overcome differential pressure load upon elevating the needle 18.

The solenoid size required is a function of pressure change at the needle. Thus, if each needle housing orifice depresses pressure at a 0.25 mm.×0.5 mm. area on the needle to zero pi, a maximum reduction, one would expect about 6 pounds per nozzle orifice, or, illustratively, 60 pounds for a 10 orifice nozzle.

A chief feature of the construction as set forth and as is seen in FIG. 4 wherein the injection orifices are located in the cylindrical side wall portion of the needle housing, whereby the needle effects the desired cylindrical sealing fit therewith when in the closed position shown, and as aided by internal fuel pressure.

While the injection bore of the needle may be of uniform diameter, it is possible and desirable to modify force v. lift characteristics of the injector by varying the size of the needle passage. Thus, at low lift of the needle and partially open orifice(s), the flow rate through the needle is low and the pressure drop low, while at high needle lift and large open orifice area, the force is higher. The same can be tailored to force characteristics of the solenoid to facilitate stable actuation.

The inventive construction effects good atomization at low injection rates as there is no need to reduce injection pressure. There is no need to wait for rail pressure to change in order to change the injection rate, and the injection rate can be varied from one cycle to the next. It follows that by controlling the shape of the electrical signal, the injection rate/crank angle curve can be continuously varied as desired, whereby the injection rate shape can be optimized independently at each engine speed/load point.

The structure is thereby simplified as there is no need to handle high injector needle forces by use of the essentially balanced system.

In the present invention, there is no need to bleed off high pressure fuel flow, of as much as 10%, as is done in current injector designs of major manufacturers, and correlatively, this leads to a reduction in mechanical power to drive the injection pump.

While preferred embodiments of the invention have been set forth herein, it is evident that an injector nozzle may take other specific forms while embracing the novel concepts herein, and fall within the appended claims.

What I claim is:

1. A variable orifice fuel injector comprising a housing, a tubular injection needle within a surrounding body including a tip area, a generally radially disposed fuel injection orifice through the tip area, said tip area further having a closed sac end, said seat having an upwardly facing frusto-conical configuration, and, the needle end having a substantially complementary downwardly-facing recessed frusto-conical configuration for seating on the seat, an operating device for reciprocating the needle within the housing to open the orifice, said needle and said housing at said tip area and orifice defining adjacent cylindrical surfaces, thereby to close the orifice when the end of the needle is in a seated lower position below the orifice, and to uncover and open the orifice when the needle is elevated by the reciprocating device.

2. The variable orifice fuel injector of claim 1 further including a spring within the housing exerting a closing force on the needle.

3. The variable orifice fuel injector of claim 1 wherein there is a small angular difference between the two frusto-conical configurations to enhance needle sealing on the seat

4. The variable orifice fuel injector of claim 1 wherein the operating device for the needle includes an electric solenoid, and an actuator rod extending between the needle and the solenoid.

5. The variable orifice fuel injector of claim 1 wherein there are provided a plurality of circumferentially spaced injection orifices in the tip area of the nozzle.

6. The variable orifice fuel injector of claim 1 wherein there is provided a further orifice in the tip area spaced axially upwardly from the said injection orifice.

7. The variable orifice fuel injector of claim 5 including axially spaced injection orifices in the tip area of the nozzle among the circumferentially spaced orifices.

8. A variable orifice fuel injector comprising a housing having a bore, a tubular injection needle within the bore, the housing including a tip area, a generally radially disposed fuel injection orifice through the tip area, said tip area further having a closed sac end, said sac end having an upwardly facing frusto-conical seat, said needle having a substantailly complementary downwardly-facing recessed frusto-conical portion for seating on the seat, an operating device for elevating the needle within the housing to open the orifice, a spring within the housing exerting a closing force on the needle, said needle and said housing at said tip area and orifice defining adjacent closely mating cylindrical surfaces, thereby to close the orifices when the end of the needle is in a lower position below the orifice, and to uncover and open the orifice when the needle is elevated by the reciprocating device, said housing including a tip portion having said tip area, an intermediate portion having an enlarged bore receiving said spring, an upper portion carrying said operating device, and a surrounding elongated cap portion securing said tip portion and said intermediate portion to said upper portion.

9. The variable orifice fuel injector of claim 8 wherein there are provided a plurality of circumferentially spaced injection orifices in the tip area of the nozzle.

10. The variable orifice fuel injector of claim 8 wherein said upper portion includes a high pressure fuel passage leading into the enlarged bore of the intermediate portion.

11. The variable orifice fuel injector of claim 8 wherein said upper portion further includes a bore, a tie rod extending through the bore and connected to the needle, and a solenoid element cooperating with said tie rod thereby to elevate the needle when actuated.

12. The variable orifice fuel injector of claim 8 wherein there is a small angular difference between the two frusto-conical configurations to enhance needle sealing on the seat

* * * * *